United States Patent [19]

Honacker

[11] 4,077,783

[45] Mar. 7, 1978

[54] INSULATOR MEANS FOR ELECTROSTATIC PRECIPITATORS

[75] Inventor: Horst Honacker, Paradise Valley, Ariz.

[73] Assignee: Dart Industries, Los Angeles, Calif.

[21] Appl. No.: 588,225

[22] Filed: Jun. 19, 1975

[51] Int. Cl.[2] ..... B03C 3/02

[52] U.S. Cl. ..... 55/146; 55/148; 55/150; 55/154; 55/DIG. 38; 174/19; 174/211

[58] Field of Search ..... 55/139, 146, 148, 150, 55/154, 157, DIG. 38, 143, 145; 174/19, 139, 211

[56] References Cited

U.S. PATENT DOCUMENTS

| | | | |
|---|---|---|---|
| 1,391,436 | 9/1921 | Welch | 55/146 |
| 1,869,475 | 8/1932 | Hale | 55/146 X |
| 1,994,259 | 3/1935 | Thorne | 55/148 X |
| 3,181,722 | 5/1965 | Huston | 174/19 X |
| 3,238,702 | 3/1966 | De Seversky | 55/DIG. 38 X |
| 3,435,397 | 3/1969 | Sankey et al. | 174/139 X |
| 3,445,580 | 5/1969 | Lusk | 174/19 X |
| 3,673,305 | 6/1972 | Mashikian et al. | 174/19 X |
| 3,785,125 | 1/1974 | De Seversky | 55/241 X |
| 3,844,205 | 10/1974 | Watanabe | 55/119 X |
| 3,856,476 | 12/1974 | De Seversky | 55/128 X |

*Primary Examiner*—Frank W. Lutter
*Assistant Examiner*—Kathleen J. Prunner
*Attorney, Agent, or Firm*—Wm. H. Dean; John A. Robertson; Don J. Flickinger

[57] ABSTRACT

The disclosure relates to an insulator means for electrostatic precipitators wherein a column is centrally supported on a base structure above which a plurality of concentric generally cylindrical and circular in cross section discharge electrodes are electrically coupled to and suspended from radially disposed arms supported on said column; said discharge electrodes being adapted to operate between respectively circular in cross section collector electrodes; said arms being supported on said column by means of a hollow insulator having a bore therethrough and a high voltage conductor extends upwardly through said bore of said hollow insulator; said conductor being electrically coupled with said arms; and grease like dielectric material packed in said bore of said insulator and surrounding said conductor therein; and a sheath surrounding said conductor and disposed between said conductor and said grease like dielectric material; the disclosure also relating to means for mechanically coupling said insulator to said arms and said column.

The disclosure also relates to novel means for providing an aerodynamic protective curtain around the insulator means so as to prevent the collection of conductive material thereon.

7 Claims, 4 Drawing Figures

INSULATOR MEANS FOR ELECTROSTATIC PRECIPITATORS

PRIOR ART

It is believed that U.S. Pat. No. 3,742,681 constitutes the most pertinent prior art relative to the subject matter of this application.

BACKGROUND OF THE INVENTION

Electrostatic precipitators and especially those wherein the collector electrodes are wet wall structures, it has been difficult to prevent the electrical bridging of various insulators used to isolate the discharge electrode high voltage from the frame or the base of the electrostatic precipitator. Inasmuch as the collector electrodes are covered with films of water, the environment of the discharge electrodes and their insulating means is always subject to damp environmental conditions especially with relation to pneumatic fluids carrying a substantial amount of water and it has, therefore, been a problem to maintain insulators in wet wall electrostatic precipitators and particularly insulators which will resist the leakage of high voltage energy under such environmental conditions. Of particular importance is the problem of arcing from a high voltage conductor to an area of the insulator which may be covered with a damp film of fluid thereon forming a conductor path to the frame of the electrostatic precipitator such that a conductor extending through the bore of a discharge electrode supporting insulator may arc to the bore when wet and ground to the frame of the machine. Such may be a problem relative to the operation of an electrostatic precipitator as disclosed in the aforementioned U.S. Pat. No. 3,742,681.

Accordingly, it will be appreciated that prior art wet wall electrostatic precipitators have encountered operational problems particularly with relation to the insulation of the high voltage discharge system from the base or frame of the machine and with relation to a high voltage conductor coupled to the electrical discharge electrode system of the respective electrostatic precipitators.

Furthermore, the prior art electrostatic precipitators have encountered difficulties with the collection of conductive material on the insulators therein which has created substantial functional and maintenance problems.

SUMMARY OF THE INVENTION

The present invention comprises a novel insulator means for electrostatic precipitators. The insulator means being mounted on a column extending upward from a base structure and mounted on the insulator and electrically insulated from the column is an assembly of concentric annular circular in cross section discharge electrodes which are suspended from arms supported on the insulator. A high voltage conductor extends upwardly through a bore centrally located in the insulator and is coupled to arms which also suspend the aforementioned discharge electrodes.

Heretofore it has been a problem to operate such electrical structure in connection with such an insulator under wet or damp environmental conditions. Under such conditions any film of water which accumulates inside the insulator may form a possible conductor to which energy will arc from the electrical conductor extending through the bore of the insulator and which is coupled to the arms which suspend and conduct to the aforementioned discharge electrodes. The present invention has solved this problem inasmuch as a grease like dielectric material fills the bore of the insulator and surrounds a high voltage conductor extending upward therethrough thereby excluding the entrance of moisture into the bore of the insulator so as to prevent the aforementioned arcing problems which are attendant to moisture on the surfaces internally of the insulator and which may also extend to an area of the supporting column or frame structure of the electrostatic precipitator. The present invention comprises a vertical column extending up from a base structure and the column is provided with an electrical conduit therein with the high voltage conductor centrally contained in the conduit and the high voltage conductor extends upward through a bore in the insulator and is surrounded therein by the dielectric grease like material which prevents the entrance of moisture into the bore of the insulator in adjacent relationship to said high voltage conductor which is coupled to and conducts energy to radially disposed arms supported on the insulator and from which the discharge electrodes of the electrostatic precipitator are suspended.

The upper end of the conductor is coupled to a disc-shaped member resting on an annular ledge in the bore of a metal fixture at the upper end of the insulator and this structure is conductively coupled to the discharge electrode supporting arms. An internally screw threaded bore portion of this structure receives an externally screw threaded plug which is screw threadably tightenable against the aforementioned disc to which the high voltage conductor is coupled so as to make firm contact of the disc with the discharge electrode supporting arms and further the disc acts as a retainer for dielectric grease like material in the bore of the insulator surrounding the high voltage conductor which itself is surrounded by a sheath disposed between the conductor and the bore and the sheath is surrounded by the dielectric grease so as to prevent the entrance of moisture into the bore of the insulator and to thereby prevent the disposition of moisture such as to form a grounding path through the insulator to which arcing might occur from the high voltage conductor. The conductor is provided with a sheath on which a clamp and seal member is located and it rests on a horizontal partition through which the sheath of the conductor extends so as to form a support for the conductor and also to retain the dielectric grease in the bore of the insulator thereabove. The exterior of the insulator is provided with a plurality of axially spaced apart radially extending fins so as to extend the surface area and to prevent a conductive path from forming longitudinally along the outside of the insulator and to thereby prevent grounding from the discharge electrode supporting arms to the column or the frame of the electrostatic precipitator of the invention.

The present invention also comprises a novel means for providing a protective aerodynamic curtain around the aforementioned insulator means. This curtain is provided by conducting clean air from a clean air source into a position between the column which supports the insulator and an innermost collector electrode closely surrounding the insulator whereby a uniform annular aerodynamic curtain is attained and which constantly flows around the insulator to prevent the collection of conductive material thereon.

Accordingly, it is an object of the present invention to provide a novel insulator structure adapted to insulate the electrode discharge system of an electrostatic precipitator from the supporting frame structure.

Another object of the invention is to provide an insulator means for wet wall electrostatic precipitators wherein a hollow cylindrical insulator is supported on a column in connection with the base of the precipitator. The insulator being provided with a bore adapted to contain a grease like dielectric material in surrounding relation with a conductor extending up through the bore so as to prevent moisture from forming a discharge path to which energy may arc from the high voltage conductor.

Another object of the invention is to provide an insulator means for electrostatic precipitators which greatly minimizes maintenance and down time of wet wall electrostatic precipitators.

Another object of the invention is to provide an insulator means for electrostatic precipitators which is particularly adapted for use in a wet or damp environment to prevent moisture path arcing between the high voltage conductor and the insulator.

A further object of the invention is to provide means for creating a novel aerodynamic curtain surrounding the aforementioned insulator of the invention to prevent the collection of conductive material on the outside of the insulator.

Further objects and advantages of the invention may be apparent from the following specification, appended claims and accompanying drawings.

DESCRIPTION OF THE PREFERRED EMBODIMENTS

Figure 1:
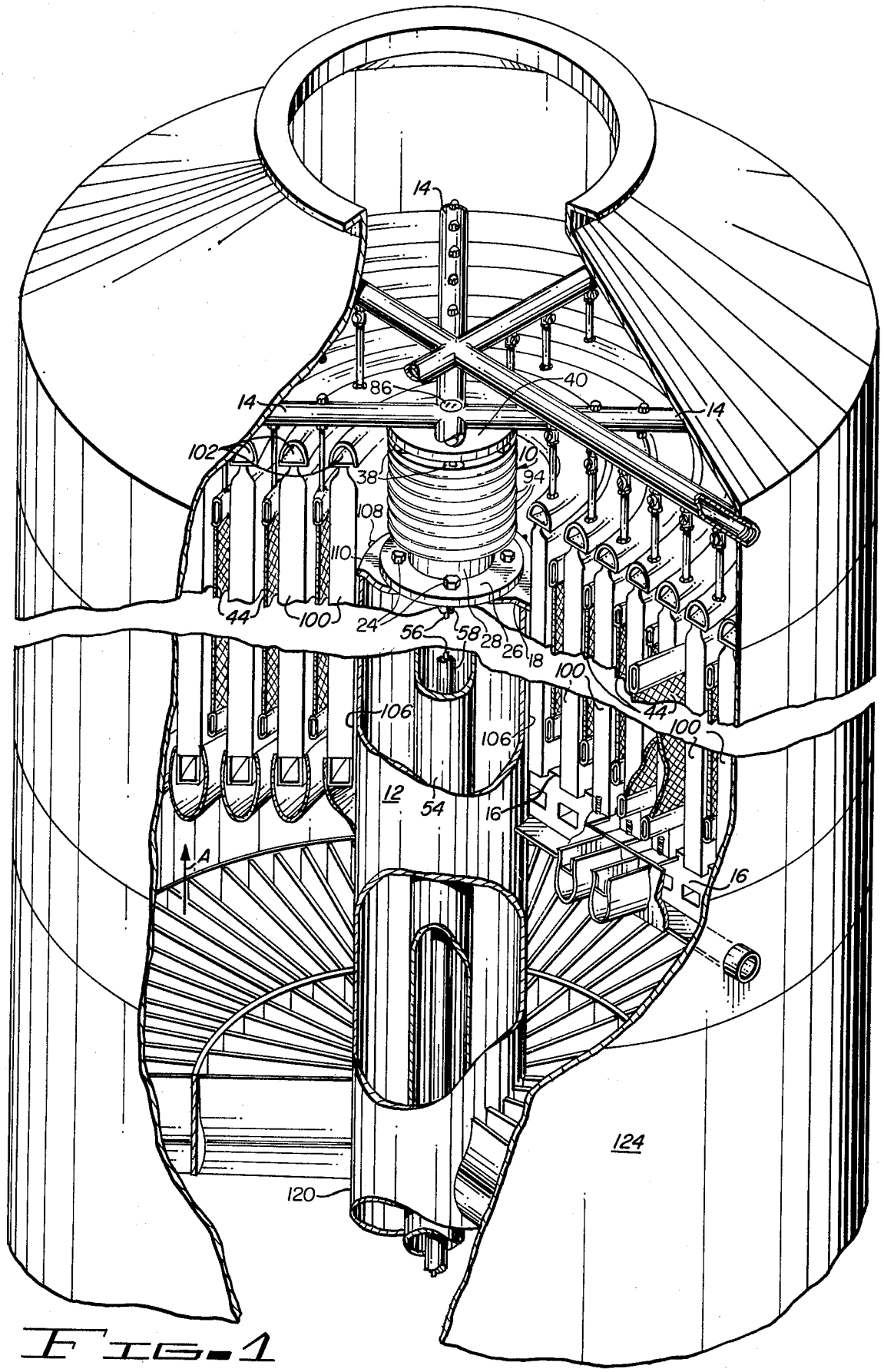
FIG. 1 is a perspective sectional view of an electrostatic precipitator showing an insulator means of the present invention relative thereto.

The invention is principally related to a novel insulator assembly 10 which is supported on a vertical column 12 and which insulates high voltage carried by discharge electrode suspending arms 14 from the column 12 or frame elements of the electrostatic precipitator. The column 12 extends upwardly from a base 16 as shown in FIG. 1 of the drawings, and an upper end plate 18 of the column 12 is provided with a generally disc-shaped plate having internally screw threaded openings 22 into which cap screws 24 are screw threadably extended and which extend through a metal flange 26 integral with which is a hollow cylindrical portion 28 retaining a hollow cylindrical portion 30 of the insulator 10. This portion 30 is provided with an internal bore 32 which extends almost the full length of the insulator 10 and an upper hollow cylindrical portion 34 of this insulator is held in and bonded to a bore 35 of a substantially cylindrical portion 36 of a flange 38 through which bolts 42 extend. These bolts 42 extend into a plate 40 which is welded or otherwise fixed to the radially disposed arms 14 so as to support these arms in cantilever position on the insulator assembly 10. The arms 14 suspend rods 46 which carry or support generally circular in cross section discharge electrodes 44 which are preferably made of mesh structure such as expanded metal or the like. The upper edge of each circular in cross section discharge electrode is provided with a rim 54 welded or fused at 52 to the respective rods 46 on which screw threaded nuts 48 and 50 are engaged with the upper and lower portions of the arms 14, it being noted that the upper portions of the rods 46 are screw threaded and extend through openings in the lower and upper portions of these arms 14 which are preferably hollow tubular members. These hollow tubular members may be of any suitable structural material such as steel and are also electrical conductors.

It will be seen that a conduit 54 extends upwardly through the column member 12 and internally of this conduit is an electrical conductor 56 adapted to conduct high voltage electrical energy. Surrounding this conductor 56 is a sheath 58 which extends through an opening 64 in a disc like partition 60 in the conduit 54 close to the insulator 10. Disposed on the partition 60 is a supporting clamp structure 62 which is clamped on the sheath 58 and bears over the opening 64 in the plate 60 through which the sheath 58 extends, thus forming a seal for grease like dielectric material which surrounds the sheath and fills the bore 32. This dielectric material being designated 66 and being preferably a silicone grease.

Figure 2:
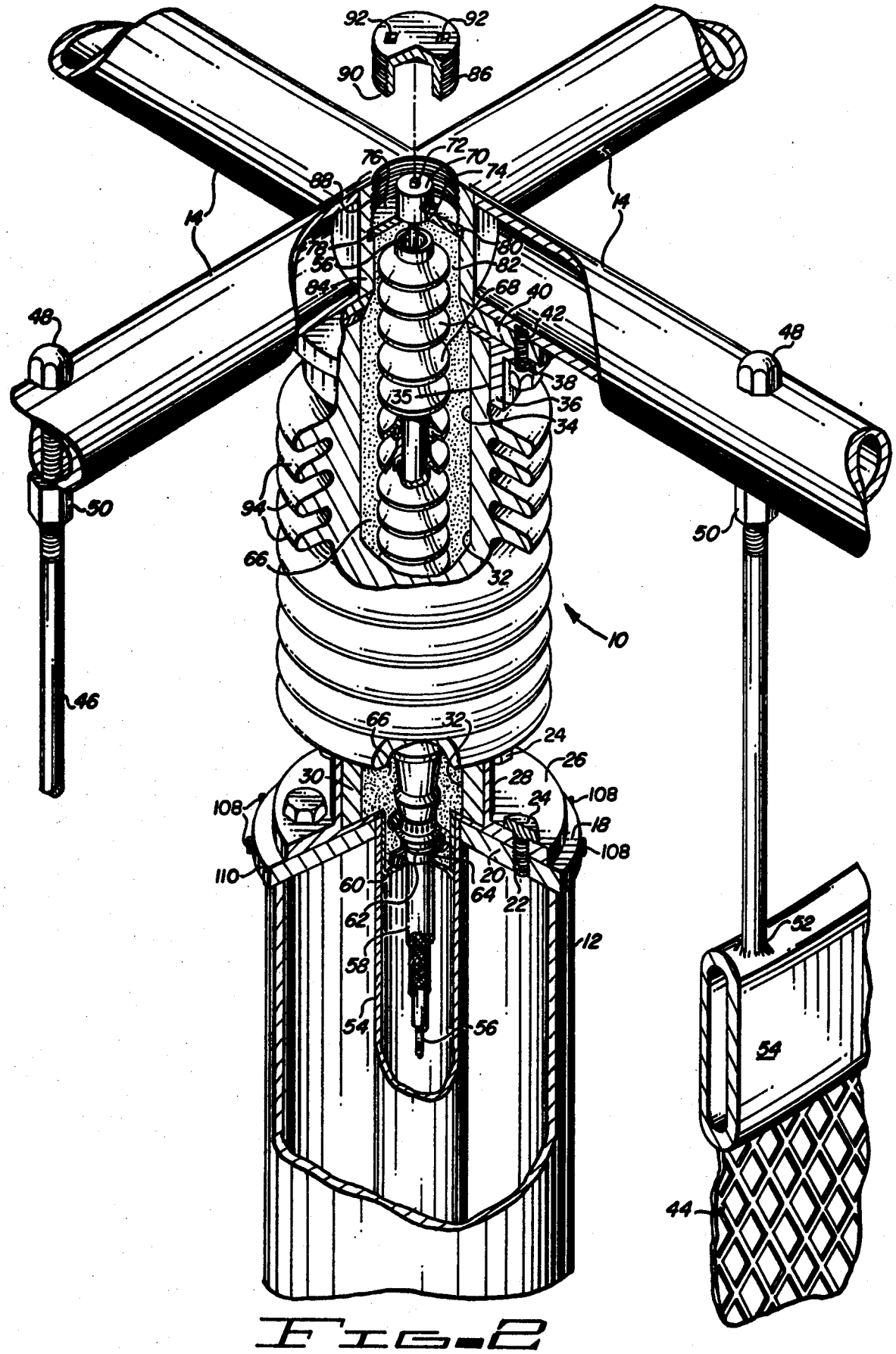
FIG. 2 is an enlarged fragmentary perspective view showing portions of the structure broken away and in section to amplify the illustration.

As shown in FIG. 2 of the drawings, the conductor 56 is surrounded by a labyrinth type insulator sheath 68 which is in turn surrounded by the dielectric grease like material 66.

The conductor 56 is electrically coupled to a nut 70 having a bore 72 which holds the conductor 56 while a clamp screw 74 makes firm electrical contact therewith. The nut 70 is fused or otherwise secured on a circular plate 76 which has a peripheral edge 78 bearing on a ledge 80 in a bore portion 82 of a metal sleeve 84 welded or otherwise secured to the plate 40 and the radially disposed arms 14.

The cylindrical portion 36, flange 38 and plate 40 and the metal sleeve 84 constitute means which couples said cantilever arm assembly and said insulator.

An externally screw threaded plug 86 is screw threadably engageable in an internally screw threaded bore 88 in the sleeve 82 so as to provide for the clamping of the plate 76 at its edge 78 against the ledge 80. The normally lower portion 90 of the plug 86 being adapted to bear upon the upper surface of the plate 76 and force it tightly against the ledge 80 when the externally screw threaded plug 86 is tightened by means of a spanner wrench engageable in recesses 92 in the upper enclosed end of the externally screw threaded plug 86.

The dielectric grease like material, preferably silicone grease, designated 66 completely fills and intimately coats the bore 32 of the insulator 10 and prevents moisture from entering the bore 32 and occupying an area surrounding the conductor 56 so as to prevent arcing from the conductor 56 to a wet path internally of the insulator. The exterior of the insulator is provided with a plurality of annular radially extending fins 94, all as shown best in FIG. 2 of the drawings.

These fins 94 are substantially conventional in insulator construction and provide the usual extended surface area as well as the usual debris shedding function which prevents the establishment of an electrical flow path downwardly along the outer surface structure of the insulator 10.

In operation, the dielectric grease like material 66 provides a great improvement in sealing the insulator around the conductor 56 and is particularly effective in the environment of a wet wall electrostatic precipitator wherein moisture laden air is ever present and wherein the structure may be subjected to the handling of various moist pneumatic fluids having a great variety of chemical constituents.

As an example of the environment, reference is made to FIG. 1 of the drawings, wherein a plurality of wet wall collector electrodes 100 are spaced apart and wherein a plurality of the discharge electrodes 44 are disposed between the collector electrodes the base 16 supporting the collector electrodes 100. All these electrodes are concentric, circular in cross section structures having a generally vertical axis substantially parallel with the bore axis of the insulator 10. Moisture laden air flows upwardly between the collector electrodes 100 and around the discharge electrodes 44 and it is necessary that the arms 14 as well as the discharge electrodes 44 be electrically insulated from the column 12 and any other object which might ground the electrical energy being supplied to the discharge electrodes 44.

The collector electrodes are supplied water through conduits 102 and the water passes downwardly around both vertical sides of the collector electrodes 100 and air flow passes upwardly in accordance with the arrow A in FIG. 1 of the drawings such as to cause an environment in which the electrode assembly 10 must function reliably and be resistent to the effects of moisture such as might cause an electrical short between the conductor 56 and the column 12.

Figures 3, 4:
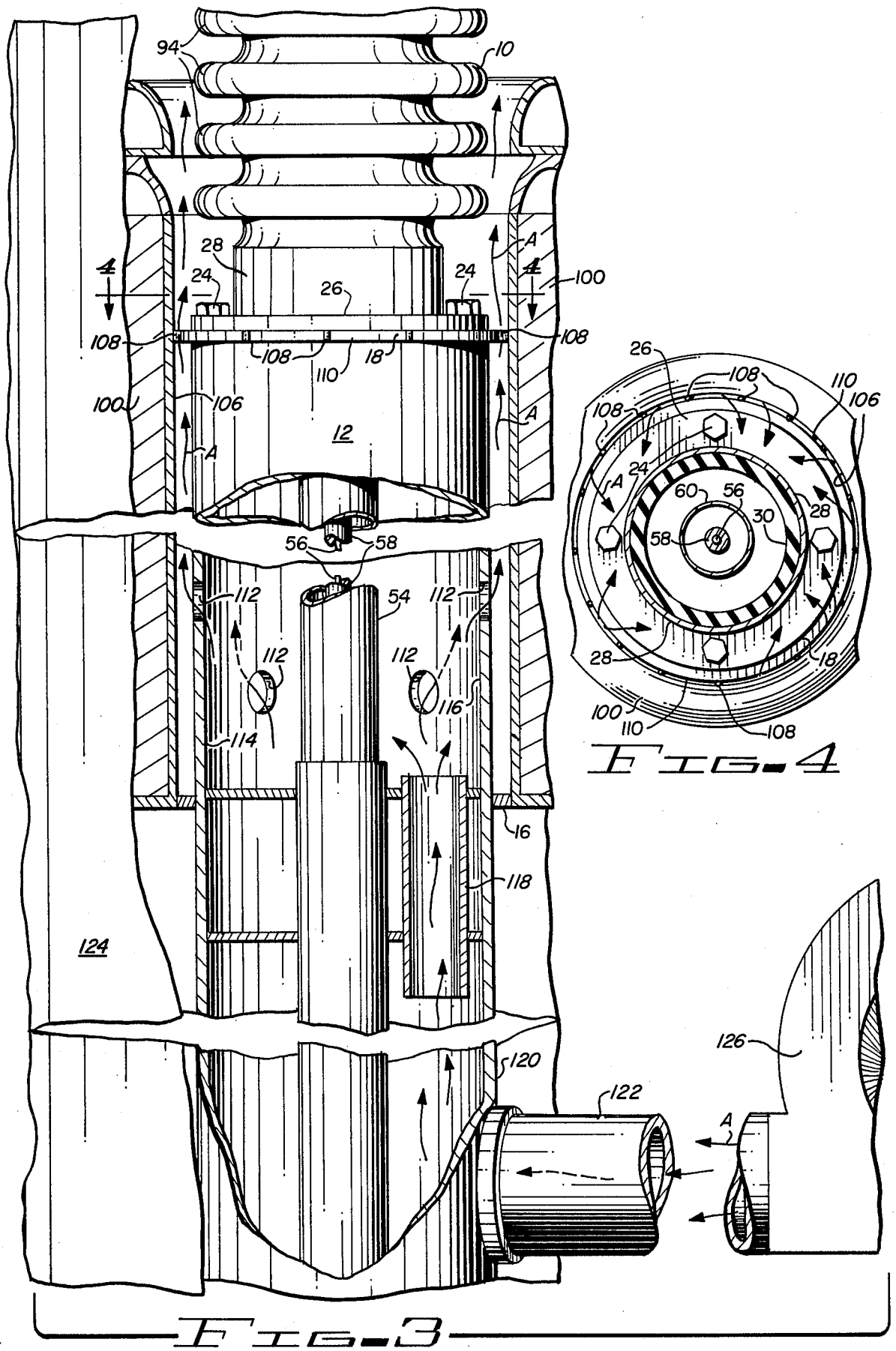
FIG. 3 is a fragmentary sectional view of means for providing an aerodynamic curtain in surrounding relation with the insulator of the invention.
FIG. 4 is a plan sectional view taken from the line 4—4 of FIG. 3.

As shown in FIGS. 1 and 3 of the drawings, an innermost collector electrode 100 is provided with an inner annular bore 106 which closely surrounds the periphery of the insulator 10 and the column 12 is disposed concentrically in said bore 106 and closely spaced relative thereto.

The column 12 is a hollow cylindrical tubular member and the plate 18 on the upper end thereof is a generally disc-shaped plate concentrically located in the bore 106 by means of spacers 108, these spacers being shown in FIGS. 3 and 4 of the drawings. Thus the plate 18 is concentrically located in the bore 106 so as to provide for uniform spacing of the periphery 110 of the plate 18 relative to the bore 106 of the innermost collector electrode 100.

As shown in FIG. 4, the spacers 108 are spaced apart so as to allow pneumatic flow therebetween in an upward direction as indicated by arrows A in FIG. 3 of the drawings. The flow as indicated by the arrows A is thus between the column 12 and the bore 106 of the innermost collector electrode 100.

It will, therefore, be appreciated that there is an annulus between the periphery 110 of the plate 18 and the bore 106 of the collector electrode 100 to thereby provide for an annular or circular aerodynamic curtain which completely surrounds the insulator 10 and flows upward in a direction of the arrow A, all as shown best in FIG. 3 of the drawings.

The aforementioned annulus is supplied clean air through openings 112 in the side wall 114 of the column member 12 and this column member 12 is provided with a bore 116 which communicates with a tubular conduit 118 which communicates with a conduit 120 therebelow having a air receiving conduit 122 which extends outward through the side wall of the housing 124 which surrounds the base 16 as well as the collector electrodes 100 and the discharge electrodes 44 hereinbefore described. The conduit 122 communicates with a blower 126 or any other suitable means for supplying clean filtered ambient air into the interior of the conduit 120 and through the conduit 118 to the interior of the hollow column 12 and then the air flows through the openings 112 and into the annulus between the column 12 and the bore 106 of the collector electrode 100. From there the air passes upwardly between the spacers 108 and thus provides a complete annular aerodynamic curtain which surrounds the insulator 10 and flows constantly upward therearound to prevent the collection of electrically conductive material thereon.

It will be obvious to those skilled in the art that various modifications may be resorted to without departing from the spirit of the invention.

I claim:

1. In an insulator means for electrostatic precipitators the combination of: an electrostatic precipitator electrode means comprising a plurality of concentric spaced apart discharge electrodes of generally hollow cylindrical and circular in cross section shape; said electrodes having a common central axis; a vertical column means located generally at said central axis; a hollow electrical insulator supported on said vertical column means and substantially aligned with said axis; a cantilever arm assembly supported on said insulator; said discharge electrodes suspended from said arm assembly and electrically coupled thereto; an electrical conductor extending upwardly through said hollow electrical insulator and coupled to said arm assembly; said insulator having a bore of considerably larger diameter than the external diameter of said conductor; and dielectric grease like material surrounding said conductor and contained in said bore of said insulator; said insulator provided with first and second metal flange means at its upper and lower ends respectively; said metal flange means each having a hollow cylindrical portion in which a respective end of said insulator is retained; said first metal flange means coupled to said cantilever arm assembly; said second metal flange means coupled to and supported on said vertical column means; said first metal flange means provided with a sleeve having a bore; ledge means in said bore; a connector plate conductively coupled to said conductor; said connector plate bearing against said ledge means; said last mentioned bore having internally screw threaded portions and an externally screw threaded plug screw threadably engaged with the internal screw threads in said bore; said plug engaging said connector plate and holding it firmly engaged with said ledge means.

2. The invention as defined in claim 1, wherein: said connector plate is disposed generally at said upper end of said insulator and retains said dielectric grease material in said insulator.

3. The invention as defined in claim 2, wherein: partition and seal means surround said conductor near said lower end of said insulator; said partition and seal means adapted for supporting said conductor and sealing against leakage of said dielectric grease like material therearound.

4. In an insulator means for electrostatic precipitators the combination of: an electrostatic precipitator electrode means comprising a plurality of concentric spaced apart discharge electrodes of generally hollow cylindrical and circular in cross section shape; said electrodes having a common central axis; a vertical hollow column means located generally concentric to said central axis; a hollow electrical insulator supported on said vertical column means and substantially aligned with said axis; a cantilever arm assembly supported on said insulator; said discharge electrodes suspended from said arm assembly and electrically coupled thereto; an electrical conductor extending upwardly through said hollow electrical insulator and coupled to said arm assembly; said insulator having a bore of considerably larger diameter than the external diameter of said conductor; and dielectric grease like material surrounding said conductor and contained in said bore of said insulator; hollow conduit means extending upwardly through said vertical column means and sealingly connected to said insulator; said conductor having a sheath therearound; clamp means tightly secured on said sheath; partition means in said hollow conduit means on which said clamp means is supported; said clamp means overlying said partition means.

5. The invention as defined in claim 4, wherein: said clamp and partition means retain said dielectric grease-like material in said insulator.

6. In an insulator means for electrostatic precipitators, the combination of: an electrostatic precipitator electrode means comprising a plurality of concentric spaced apart discharge electrodes of generally hollow cylindrical and circular in cross section shape; said electrodes having a common central axis; a hollow vertical column means located concentric to said central axis; a hollow electrical insulator supported on said vertical column means and substantially aligned with said axis; a cantilever arm assembly supported on said insulator; said discharge electrodes suspended from said arm assembly and electrically coupled thereto; an electrical conductor extending upwardly through said hollow electrical insulator and coupled to said arm assembly; a plurality of hollow cylindrical and circular in cross section collector electrodes disposed between said discharge electrodes; one of said collector electrodes surrounding said insulator in close proximity thereto; and means for conducting clean pneumatic purge fluid between said one of said collector electrodes and said insulator to provide an aerodynamic curtain in surrounding relation to said insulator to prevent the collection of electrical conducting material on said insulator; said vertical column means is a hollow tubular member having a side wall provided with openings therein; a base for supporting said collector electrodes; first conduit means communicating with the interior of said vertical column means; a main housing surrounding said base and said electrodes and second conduit means disposed communicating with said first conduit means to supply clean pneumatic fluid into said main housing and to said first conduit means whereby said pneumatic fluid is supplied through said openings in said side wall of said vertical column means and between said vertical column means and said one of said collector electrodes so as to provide said aerodynamic curtain surrounding said insulator.

7. The invention as defined in claim 6, wherein: spacers are located generally at the upper end of said vertical column means and thereby space said vertical column means from said one of said collector electrodes; said spacers spaced from each other to provide an even and uniform aerodynamic annulus.

* * * * *